US005282595A

United States Patent [19]

Conforti

[11] Patent Number: 5,282,595

[45] Date of Patent: Feb. 1, 1994

[54] ARTICLE SUPPORT APPARATUS

[76] Inventor: Carl J. Conforti, P.O. Box 6315, Fall River, Mass. 02724

[21] Appl. No.: 952,343

[22] Filed: Sep. 28, 1992

[51] Int. Cl.[5] ..... E04G 3/00

[52] U.S. Cl. ..... 248/214; 248/225.31; 248/231.8; 211/88

[58] Field of Search ..... 248/201, 214, 225.31, 248/231.8, 248, 300; 211/134, 88, 86; 108/42, 46, 90

[56] References Cited

U.S. PATENT DOCUMENTS

| | | | |
|---|---|---|---|
| 466,932 | 1/1892 | Cornell | 248/214 |
| 1,068,391 | 7/1913 | Jensen | 248/248 |
| 2,647,716 | 8/1953 | Hudziak et al. | 248/231.8 |
| 3,389,696 | 6/1968 | Lake | 248/201 |
| 4,033,538 | 7/1977 | Levy | 248/225.31 |
| 4,052,816 | 10/1977 | Perez | 211/88 |
| 4,059,248 | 11/1977 | Kuntz | 248/214 |
| 5,042,770 | 8/1991 | Louthan | 248/214 |

*Primary Examiner*—Richard K. Seidel
*Assistant Examiner*—Hwei-Siu Payer

[57] ABSTRACT

An article support is shown having an upper portion of expanded surface area and a bottom portion from which depends structure for attaching the support to a rail member of a deck or patio. The upper portion may be formed of a series of spaced slats or it may be formed having a continuous surface. Several embodiments are shown forming the depending structure including one or more pairs of generally L-shaped elements, the elements of each pair spaced a fixed or an adjustable distance in relation to one another. Another embodiment uses an elongated flexible strap for attachment to a rail. Yet another embodiment provides compensation for manufacturers variation on rail sizes, with a spring biased cantilever surface portion.

7 Claims, 4 Drawing Sheets

ARTICLE SUPPORT APPARATUS

BACKGROUND OF INFORMATION

The present invention generally relates to a device for supporting various articles and more specifically to a tray particularly adapted for mounting on a rail type surface such as those used with deck and patio construction.

Decks and patios defining outdoor living space have become very popular in recent years. Frequently such decks and patios are raised above ground level and generally are circumscribed with some type of rail to provide containment of occupants, as well as to provide a convenient structure on which to lean or rest one's elbows. Small tables are frequently used to provide a surface on which to place various articles such as beverages, food, plants and the like. However, during social gatherings, since many of such decks and patios are relatively small in surface area, people tend to use the top side of the rail surfaces as a support for their beverages, plants and the like. Since the rail surface is relatively narrow this presents limited space on which to place items as well as a precarious and unsafe location with significant likihood of items being accidentally knocked off the surface. Although conventional trays can be balanced on flat top surfaces of rails to provide greater storage space they are even more unstable since a proper balance of items on the tray has to be maintained to prevent tipping of the tray. Therefore, the present invention is directed to the object of providing a unique solution for a means to attach a article support device to a rail member.

SUMMARY OF THE INVENTION

It is an object of the present invention to provide an improved, stable article support particularly adapted for use with outdoor decks and patios. Another object of the invention is the provision of an article support having expanded surface area for use with rails of outdoor decks and patios which is light in weight and easy to assemble and which will not disfigure or damage the rail. Yet another object is the provision of a stable support for various articles which can be readily attached to rails of various sizes.

These and other objects of the present invention will become more fully apparent from the following detailed description when read in conjunction with the accompanying drawings, in which like reference numerals refer to like parts.

Briefly, in accordance with the invention, an article support has top and bottom portions with means including at least two spaced downwardly depending elements disposed on the bottom portion for secure engagement with opposite sides of the rail. According to a feature of the invention, the downwardly depending elements are optionally movable to provide adjustable spacing to fit different size rails. The top portion is enlarged to provide an expanded article support area and may comprise a solid surface or a plurality of spaced slats. According to a feature of the invention an upstanding side wall preferably circumscribes the solid surface and in the spaced slat embodiment the outer two slats are of greater height than the inner slats. According to one embodiment a plurality of generally L-shaped elements have one leg attached to the bottom portion of the article support and have a second leg extending downwardly therefrom. The second legs of a pair are spaced a selected distance from one another equidistantly relative to the front and back extremities of the top portion of the article support so that a rail member can be closely received between the second legs of each pair. Preferably the L-shaped elements of a pair are relatively adjustably movable toward and away from each other to accommodate different sizes of rails. Modified embodiments include adjustable snap in legs comprising resiliently compressible and expandable locking tabs and a cooperating vertically extended support engageable with the rails outer surfaces. Another modified embodiment comprises a strap like device adapted to wraparound the outer surface of a rail. Yet another modification includes cantilever spring elements formed in the legs to compensate for variation between rails due to manufacturing tolerances and the like.

DETAILED DESCRIPTION OF THE PREFERRED EMBODIMENTS

Figure 1:
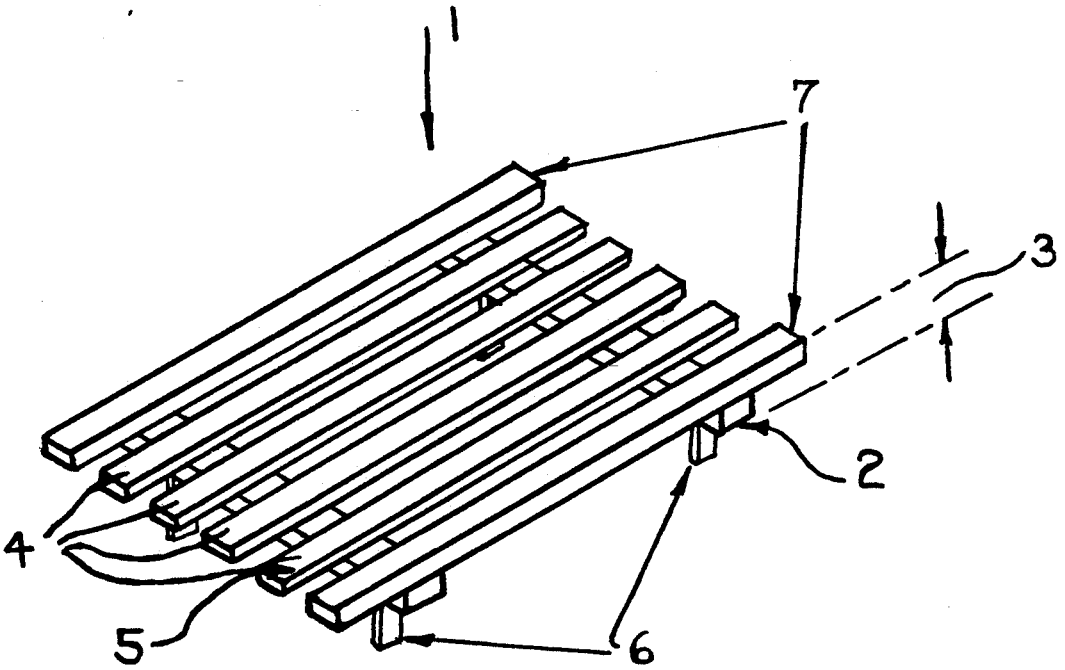
FIG. 1 is a top perspective view of an article support assembly made in accordance with the invention.
Figure 1A:
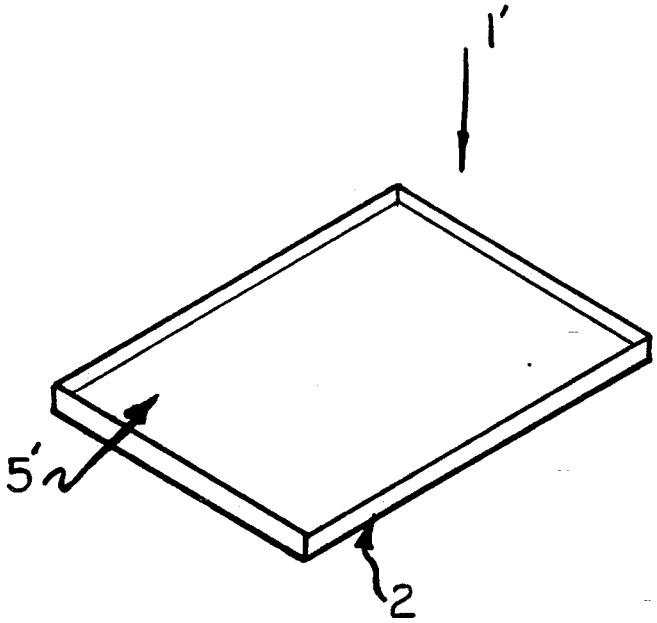
FIG. 1*a* is a view similar to FIG. 1 of a modified embodiment.
Figure 2A:
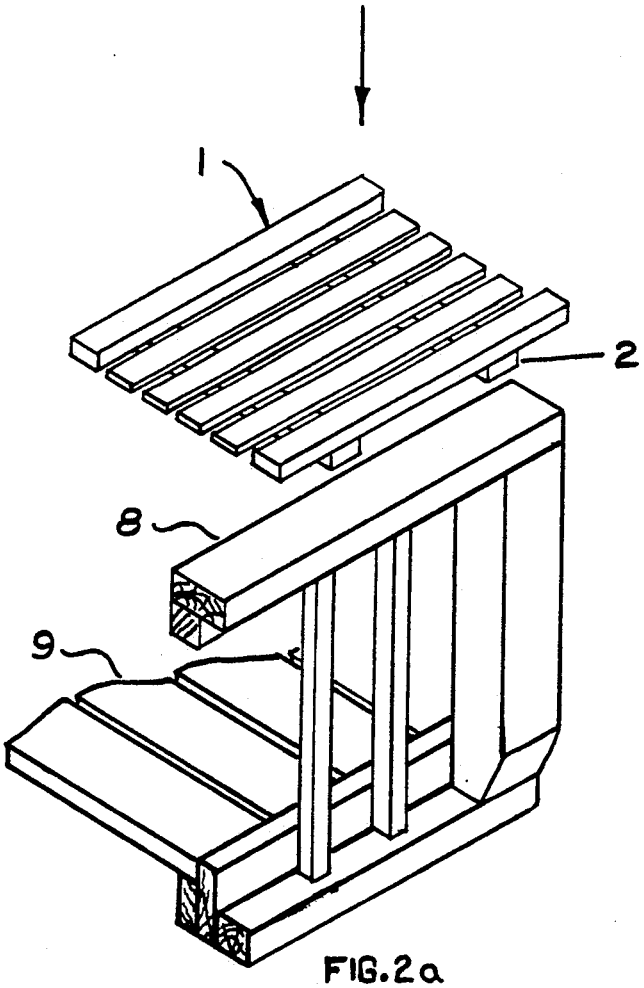
FIG. 2*a* is a top perspective view of the FIG. 1 support about to be engaged with a rail.
Figure 2C:
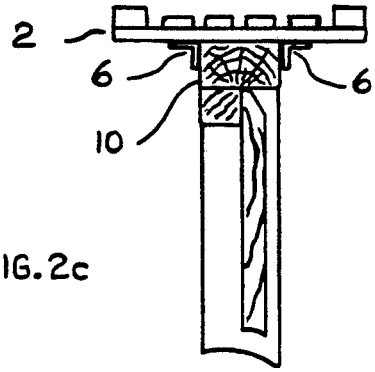
FIG. 2*c* is a side view illustrating the minimum of two surfaces in contact with the rail.
Figure 2B:
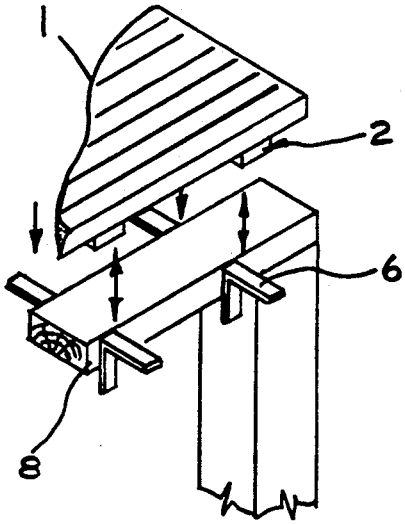
FIG. 2*b* is a portion of FIG. 2*a* shown with the rail engaging elements separated from the support for purposes of illustration.
Figure 3:
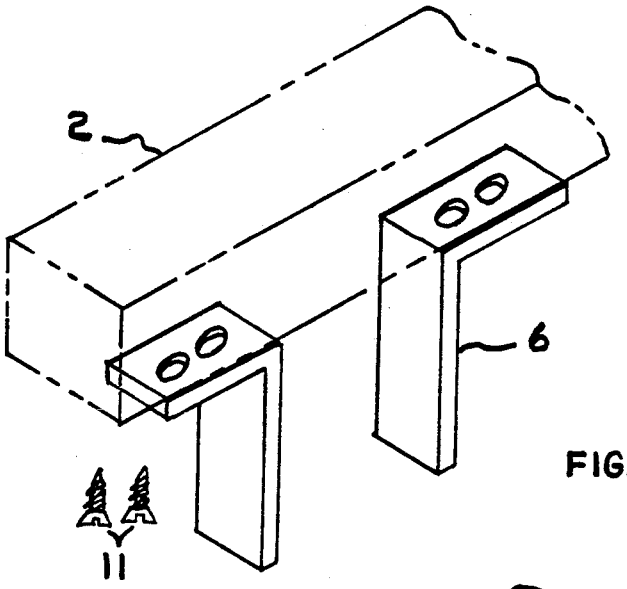
FIG. 3 is a perspective view of the rail engaging elements of the FIG. 1 embodiment.

Referring now to the drawings, as seen in FIG. 1 and 1*a*, this invention comprises an article support assembly 1 having an upper suppose portion having an article support surfaces and a bottom portion 2 including rail engaging means 6 for attaching support assembly 1 to a rail. The article support assembly and means of attachment can more specifically be defined as a portion having a top surface area with relative thickness 3, typically including a bottom portion 2, with a rail engaging means 6 for attaching the suppose assembly to a rail. The upper portion comprise a series of spaced apart slats 4, preferably equally spaced as seen in FIG. 1, wherein the outer slat members 7 on each opposite side preferably have a height greater than the remaining slat members 4. However, if desired, the upper support portion of article support assembly 1' may be formed having a continuous solid upper surface 5' as shown in FIG. 1*a*. It is within the purview of the invention to provide shapes other than a rectangular configuration. A rail 8 (FIG. 2*a*), part of a typical deck or patio construction 9, is particularly suitable to be received between a pair of aligned downwardly depending, spaced rail engaging elements 6 of the article support assembly 1. With reference to FIGS. 2a–c, rail engaging elements 6 typically depend from the bottom portion 2 of the article support assembly, are shown fragmented in FIG. 2b on the rail, separated from the bottom portion 2. The bottom portion 2 having at least one pair of aligned, rail engaging elements 6, as seen in FIG. 2c, for vertically centrally balanced load support, extending downwardly from the bottom surface of the bottom portion 2 of the article support, assembly closely engage a minimum of two opposed rail surfaces 10. The aligned rail engaging elements 6 extend downwardly generally in parallel relation to each other. In the first embodiment the rail engaging elements are generally L-shaped fastened to the bottom surface of bottom portion 2 of the article support assembly using a conventional fastener 11 shown in FIG. 3. A plurality of separate pairs of parallel extended elements are preferably positioned to engage with longitudinally spaced portions of rail surfaces 10.

Figure 4:
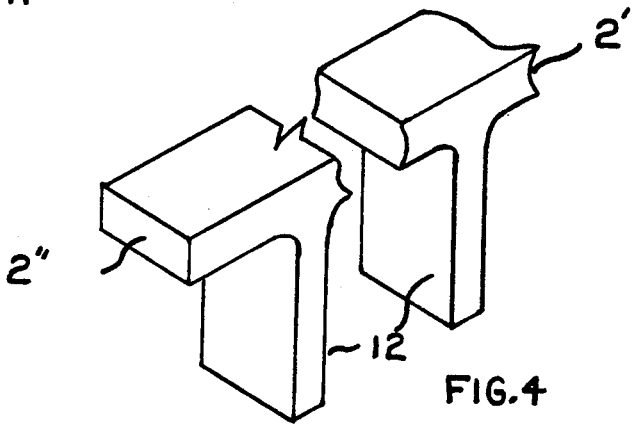
FIG. 4 is a perspective view of a modified embodiment of the invention.
Figures 5A, 5B, 5C:
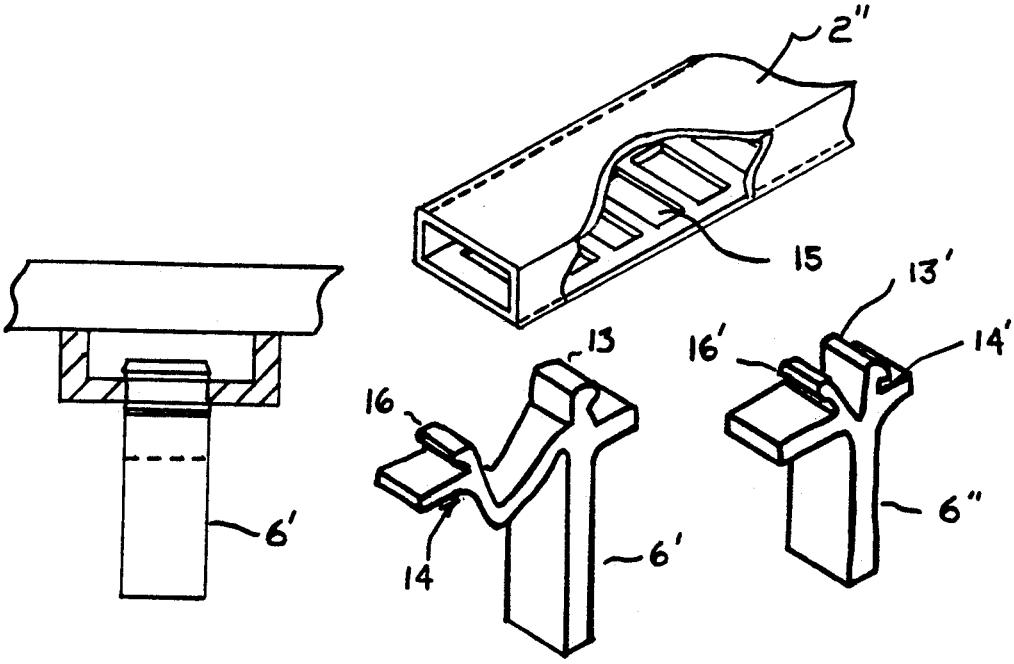
FIG. 5*a* is a cross-sectioned view taken through a modified support.
FIG. 5*b* is a perspective view of FIG. 5*a* support and rail engaging element used therewith.
FIG. 5*c* is a perspective view of another modified rail engaging element.

A modified embodiment is shown in FIG. 4 wherein a surface 12 extending downwardly from the bottom portion 2' of the article support assembly may be a single pair of vertical surfaces as part of and integrally formed with the upper support portion extending outwardly from the bottom portion 2' bottom surface, or it may comprise a single fixed attaching element 12 in conjunction with an adjustable attaching element shown in FIGS. 5a and 5b to comprise an aligned pair of rail engaging elements. The rail engaging element shown in FIGS. 5a and 5b illustrate a selectively adjustable rail engaging element 6' in FIG. 5a and 6'' in FIG. 5b. In FIG. 5a element 6' has a resilient locking mechanism 14 comprised of a resilient compressible and expandable lock arm 13 and spring arm 16. Tubular support surface 2'' is formed with a plurality of spaced apertures 15 in a row formed in the bottom wall portion of support surface 2' having spaced upper and lower wall portions. Spring arm 16 is received in a selected aperture and compressed, allowing engagement of the locking arm 13 in another of the series of apertures.

In FIG. 5c rail engaging element 6'' comprises a spring arm 16' configured as a mirror image of locking arm 13'. Spring arm 16' and locking arm 13' are cammed into selected apertures 15 to provide desired adjustment.

Figure 6A:
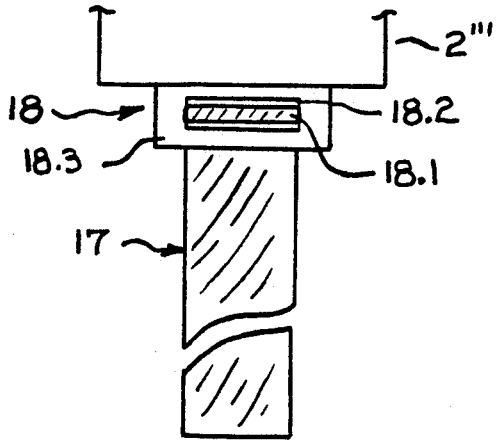
FIG. 6*a* and 6*b* are side and perspective views respectively of another embodiment of the invention.
Figure 6B:
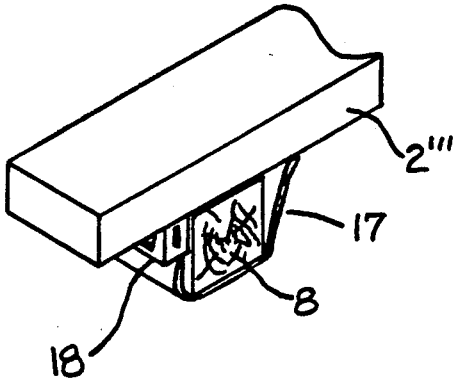

Yet another embodiment is shown in FIGS. 6a and 6b, wherein an elongated strap like member 17 with substantial length having an attaching end 18.1 and an opposite end fixed to the bottom portion 2''' on the bottom surface thereof by any suitable means is adapted to wrap around the outer surface of rail 8 with end 18.1 received, as shown at 18, in a slot 18.2 formed in a member 18.3 attached to the bottom surface to prevent up and down vertical movement of the support assembly.

Figure 7A:
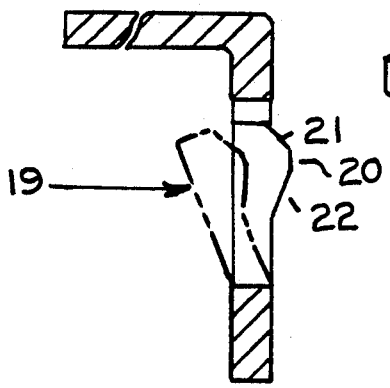
FIG. 7*a* is a cross-sectional view of another embodiment of the invention shown in perspective in FIG. 7*b*.
Figure 7B:
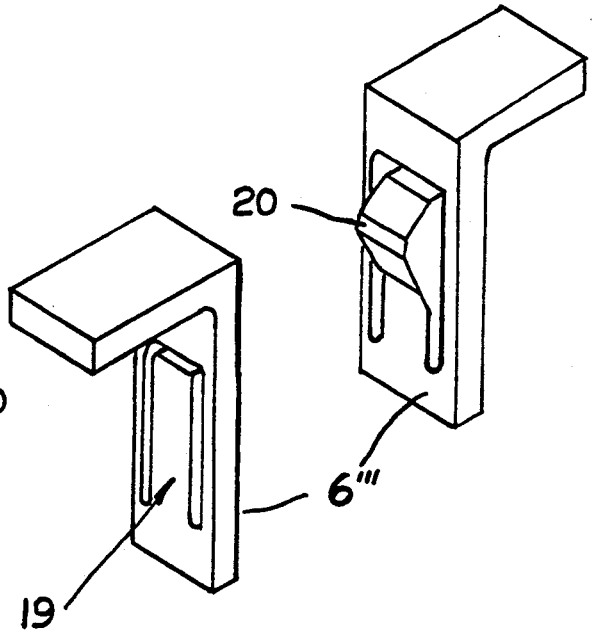

Another embodiment shown in FIGS. 7a and 7b provides a means to compensate for variations between rails having slightly different thicknesses due to manufacturing tolerances and the like. The rail engaging elements 6''' comprising a minimum of one pair of aligned, downwardly extending generally L-shaped elements preferably spring biased 19 surface portion in the form of a tongue 20 formed in the leg of at least one of the elements of a pair and integrally attached thereto in cantilever fashion facing toward corresponding leg of the other element of the respective pair. The tongue has a free distal end which is permanently bent out of the plane in which the remainder of the leg lies and extends toward the other corresponding leg. The tongue is formed with a projection having a taper 21, 22 on either side thereof in the vertical plane for ease of engaging and disengaging the article support with minimal resistance.

From the above description it will be seen the article support assembly conveniently increases the overall effective surface area of the rail. The downwardly extending rail engaging means having means engaging at least two opposed surfaces of a rail provides secure, stable support for the upper body portion. The rail attachment or engagement means are centrally located to provide a firm, balanced support surface for various articles, even articles of considerable weight, such as flower pots and the like. When a plurality of pairs of attachment elements are employed they are located in parallel relationship with one another and are disposed from the center of the rail outwardly and equidistantly spaced in opposite directions. The rail attachment means are adapted to engage rails of various widths, for example from one to nine inches or more. Availability of space and storage area is optimized by using the article support assembly made in accordances with the invention. The article support assembly can easily be made using inexpensive construction techniques and can be easily assembled and disassembled and conveniently stored, without disfiguring or marring a rail member. While several illustrative embodiments of the invention have been shown and described, numerous variations and alternative embodiments will occur to those skilled in the art without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

I claim:

1. Article support apparatus comprising an upper body portion having an expanded article support surface defined by a selected outer periphery and a bottom portion, rail engaging means disposed inwardly of the outer periphery and depending downwardly from the bottom portion and being adapted to closely engage at least two opposed sides of a rail member, a series of apertures formed in a row in the bottom portion, the rail engaging means comprising a pair of spaced apart, aligned elements, at least one of the elements having at an end thereof a spring arm receivable in an aperture of the row and a locking arm received in another aperture of the row upon compression of the spring arm.

2. Article support apparatus according to claim 1 in which the upper body portion comprises a plurality of parallel extending, spaced slat members, allowing drainage between adjacent slat members through the upper body portion.

3. Article support apparatus according to claim 2 in which the outer slat member on each opposite side has a height greater than the remaining slat members.

4. Article support apparatus according to claim 1 in which both elements of the pair of spaced apart, aligned elements are formed with spring and locking arms.

5. Article support apparatus comprising an upper body portion having an expanded article support surface defined by a selected outer periphery and bottom portion, rail engaging means disposed inwardly of the outer periphery and depending downwardly from the bottom portion and being adapted to closely engage at least two opposed sides of a rail member, the rail engaging means comprising of a pair of spaced apart, aligned, generally L-shaped elements having first and second legs formed of resilient material, a first leg of each element of a pair facing the respective first leg of the other element of the pair and an integrally formed tongue is struck out of at least one of the first legs, the tongue extending in a cantilever fashion having a free distal end and being permanently deformed out of a plane in which the respective first leg lies towards the other first leg of the pair.

6. Article support apparatus according to claim 5 in which a projection is formed on the free distal end of the tongue, the projection having a smooth tapered surface extending to the tongue above and below the projection.

7. Article support apparatus comprising an upper body portion having an expanded article support surface defined by a selected outer periphery and bottom portion, rail engaging means disposed inwardly of the outer periphery and depending downwardly from the bottom portion and being adapted to closely to engage at least two opposed sides of a rail member, the rail engaging means comprising a strap having opposite ends with one end fixed to the bottom portion, a member having opposite sides mounted on a bottom surface of the bottom portion and being formed with a slot extending through the member between the opposite sides, the slot adapted to receive the other end of the strap whereby the strap can be wrapped around a rail member and received through the slot.

* * * * *